US006593047B2

(12) United States Patent
Azuma et al.

(10) Patent No.: US 6,593,047 B2
(45) Date of Patent: Jul. 15, 2003

(54) SINGLE-LAYER TYPE ELECTROPHOTOSENSITIVE MATERIAL

(75) Inventors: Jun Azuma, Osaka (JP); Yukimasa Watanabe, Osaka (JP); Hisakazu Honma, Osaka (JP); Ayako Yashima, Osaka (JP); Maki Uchida, Osaka (JP); Kyoichi Nakamura, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/942,654

(22) Filed: Aug. 31, 2001

(65) Prior Publication Data

US 2002/0045119 A1 Apr. 18, 2002

(30) Foreign Application Priority Data

Aug. 31, 2000 (JP) ..... 2000-262354
Feb. 20, 2001 (JP) ..... 2001-043323

(51) Int. Cl.[7] ..... G03G 5/05
(52) U.S. Cl. ..... 430/96; 430/56; 430/73
(58) Field of Search ..... 430/96, 56, 72, 430/73, 78

(56) References Cited

U.S. PATENT DOCUMENTS 5,876,892 A 3/1999 Fujimori et al. ..... 430/83
6,190,812 B1 * 2/2001 Imanaka et al. ..... 430/83
6,395,439 B1 * 5/2002 Sugai et al. ..... 430/58.25

FOREIGN PATENT DOCUMENTS

| | | |
|---|---|---|
| DE | 198 29 05 | 1/1999 |
| EP | 0 896 975 | 2/1999 |
| JP | 2001-013701 | 6/1999 |

* cited by examiner

*Primary Examiner*—John Goodrow
(74) *Attorney, Agent, or Firm*—Smith, Gambrell & Russell, LLP

(57) ABSTRACT

A single-layer type electrophotosensitive material comprising a conductive substrate and a photosensitive layer made of a binder resin containing at least an electric charge generating material and a hole transferring material and an electron transferring material as an electric charge transferring material, which is formed on the conductive substrate, characterized in that the binder resin contains a polycarbonate resin having a repeating structural unit represented by the general formula [1] and the solid content of the hole transferring material and the electron transferring material is not less than 30% by weight and not more than 50% by weight relative to the entire solid content, exhibits good wear resistance with respect to the photosensitive layer and is also superior in durability.

15 Claims, 2 Drawing Sheets

SINGLE-LAYER TYPE ELECTROPHOTOSENSITIVE MATERIAL

BACKGROUND OF THE INVENTION

The present invention relates to a single-layer type electrophotosensitive material, which is used in image forming apparatuses such as electrostatic copying machine, facsimile and laser beam printer. More particularly, the present invention relates to a single-layer type electrophotosensitive material, which is less likely to cause wear even when used in image forming apparatuses equipped with a blade cleaning means, and is also superior in durability.

In the image forming apparatuses described above, various photosensitive materials having the sensitivity within a wavelength range of a light source used in said apparatuses have been used. One of them is an inorganic photosensitive material using an inorganic material such as selenium in a photosensitive layer, while the other one is an organic photosensitive material (OPC) using an organic material in a photosensitive layer. Among these photosensitive materials, the organic photosensitive material has widely been studied because it is easily produced as compared with the inorganic photosensitive material and has a wide range of choice of photosensitive materials such as electric charge transferring material, electric charge generating material and binder resin as well as high functional design freedom.

The organic photosensitive materials are classified roughly into a so-called multi-layer type electrophotosensitive material having a structure of an electric charge generating layer containing an electric charge generating material and an electric charge transferring layer containing an electric charge transferring material, which are mutually laminated, and a single-layer type photosensitive material wherein an electric charge generating material and an electric charge transferring material are dispersed in the same photosensitive layer. Among these organic photosensitive materials, it is a multi-layer type photosensitive material, which has a monopoly position in the wide market.

The single-layer type photosensitive material has become of major interest recently because of its advantages described below. That is, the single-layer type photosensitive material is superior in productivity because of its simple layer construction and can inhibit the occurrence of layer defects of the photosensitive layer, and can also improve optical characteristics because of less interface between layers. Furthermore, one photosensitive material can be used as both of positive and negative charge type photosensitive materials by using, as the electric charge transferring material, an electron transferring material and a hole transferring material in combination.

The electrophotosensitive material is used in the repeated steps of charging, exposing, developing, transferring, cleaning and charge neutralizing in the image formation process. An electrostatic latent image formed by charging/exposure is developed with a toner as a powder in the form of microparticles. Furthermore, the developed toner is transferred to a transfer material such as paper in the transfer process. However, the toner is not transferred completely (100%) and is partially remained on the photosensitive material. If the remained toner is not removed, it is made impossible to obtain a high-quality image, which is free from contamination in the repeated processes. Therefore, it is required to clean the remained toner.

In the cleaning process, a fur brush, a magnetic brush or a blade is typically used. In view of the cleaning accuracy and rationalization of apparatus construction, it is general to select a blade cleaning wherein cleaning is performed by contacting a blade-shaped resin plate directly with a photosensitive material.

As described above, according to the blade cleaning, the remained toner on the surface of the photosensitive material is removed by contacting the blade-shaped resin plate with the surface of the photosensitive material. Although the blade cleaning has high accuracy, it increases a mechanical load on the photosensitive material, thereby causing problems such as increase in wear quantity of the photosensitive layer, reduction in surface potential, lowering of the sensitivity and the like, thus making it difficult to obtain a high-quality image.

It is possible to reduce the wear quantity of the photosensitive layer by decreasing a pressing force (blade linear pressure) exerted on the surface of the photosensitive material by the cleaning blade. However, the remained toner passes through a microspace between the blade and the surface of the photosensitive material in the pressed state and adheres firmly to the surface of the photosensitive material in the state where toner particles are crushed and thus the remained toner is not removed by the blade, that is, a so-called "dash mark" or "toner filming" phenomenon occurs to drastically reduce the potential of the surface of the photosensitive material at the portion where the toner is fused. Also no optical attenuation occurs because of light screening, thus causing defects of images.

To the contrary, when the blade linear pressure is increased to prevent dash mark or toner filming, a mechanical load on the surface of the photosensitive material increases and the wear quantity of the photosensitive layer increases, thereby deteriorating electric characteristics, thus making it difficult to obtain a high-quality image. A resonance sound is created when the blade slides over the surface of the photosensitive material, that is, a so-called "blade squeaking" phenomenon occurs.

SUMMARY OF THE INVENTION

An object of the present invention is to provide a single-layer type electrophotosensitive material, which exhibits good wear resistance with respect to the photosensitive layer even when used in image forming apparatuses equipped with a blade cleaning means, and is also superior in durability. Another object of the present invention is to provide a highly sensitive single-layer type electrophotosensitive material, which causes none of blade squeaking, dash mark and toner filming.

The present inventors have intensively studied and found that a single-layer type electrophotosensitive material comprising a conductive substrate and a photosensitive layer made of a binder resin containing at least an electric charge generating material and a hole transferring material and an electron transferring material as an electric charge transferring material, which is formed on the conductive substrate, wherein the binder resin contains a polycarbonate resin having a repeating structural unit represented by the general formula [1]:

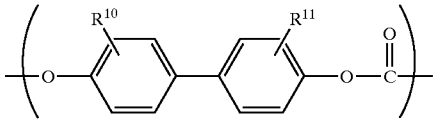

wherein $R^{10}$ and $R^{11}$ are the same or different and each represents a hydrogen atom or an alkyl group having 1 to 3 carbon atoms, and the solid content of the electric charge transferring material (hole transferring material and electron transferring material) is not less than 30% by weight and not more than 50% by weight based on the entire solid content, exhibits good wear resistance with respect to the photosensitive layer even when used in an image forming apparatus equipped with a blade cleaning means, and is also superior in durability.

Also, the present inventors have found that the single-layer type electrophotosensitive material, which further contains as the binder resin the following polycarbonate resin having a repeating structural unit represented by the general formula [2] and/or the following copolymer polycarbonate resin having a repeating structural unit represented by the general formula [3], exhibits good wear resistance with resect to the photosensitive layer even when used in an image forming apparatus equipped with a blade cleaning means, is excellent in durability, and causes none of blade squeaking, dash mark and toner filming.

A polycarbonate resin having a repeating structural unit represented by the general formula [2]:

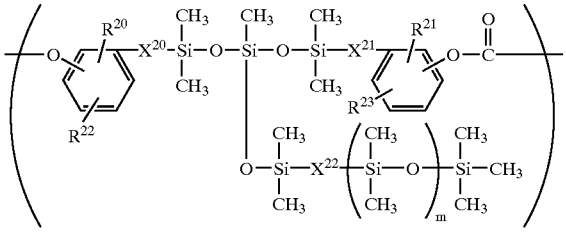

wherein $X^{20}$, $X^{21}$ and $X^{22}$ are the same or different and each represents —$(CH_2)_n$—, n represents an integer of 1 to 6; $R^{20}$, $R^{21}$, $R^{22}$ and $R^{23}$ are the same or different and each represents a hydrogen atom, a phenyl group, or an alkyl or alkoxy group having 1 to 3 carbon atoms; and m represents a numerical value of 0 to 200.

In the present invention, the binder resins include a copolymer polycarbonate resin consisting of a repeating structural unit represented by the general formula [1] and a repeating structural unit represented by the general formula [2] and a mixed resin of the polycarbonate resin having a repeating structural unit represented by the general formula [1] and the polycarbonate resin having a repeating structural unit represented by the general formula [2].

A copolymer polycarbonate resin having a repeating structural unit represented by the general formula [3]

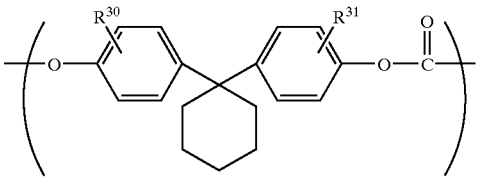

wherein $R^{30}$ and $R^{31}$ are the same or different and each represents a hydrogen atom or an alkyl group having 1 to 3 carbon atoms.

Furthermore, the present inventors have found that each single-layer type electrophotosensitive material, which contains the following compound of the general formula [4], [5], [6] or [7] as the electron transferring material and the following compound of the general formula [8], [9], [10] or [11] as the hole transferring material, exhibits good wear resistance with respect to the photosensitive layer, causes none of blade squeaking, dash mark and toner filming, and has very high sensitivity.

A compound represented by the general formula [4]:

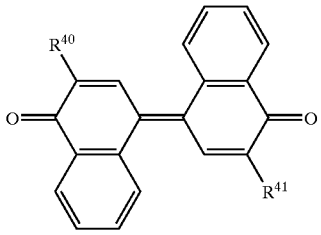

wherein $R^{40}$ and $R^{41}$ are the same or different and each represents an alkyl group which may have a substituent.

A compound represented by the general formula [5]:

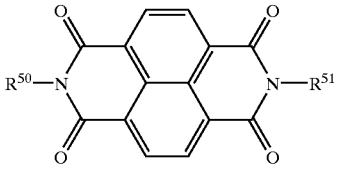

wherein $R^{50}$ and $R^{51}$ are the same or different and each represents a monovalent hydrocarbon group which may have a substituent.

A compound represented by the general formula [6]:

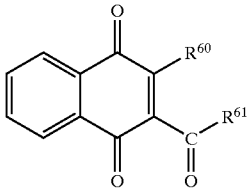

wherein $R^{60}$ represents a halogen atom, or an alkyl or aryl group which may have a substituent; $R^{61}$ represents an alkyl or aryl group which may have a substituent, or a group: —O—$R^{61a}$; and $R^{61a}$ represents an alkyl or aryl group which may have a substituent.

A compound represented by the general formula [7]:

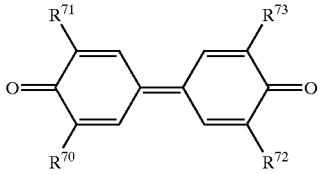

wherein $R^{70}$, $R^{71}$, $R^{72}$ and $R^{73}$ are same or different and each represents an alkyl group which may have a substituent.

A compound represented by the general formula [8]:

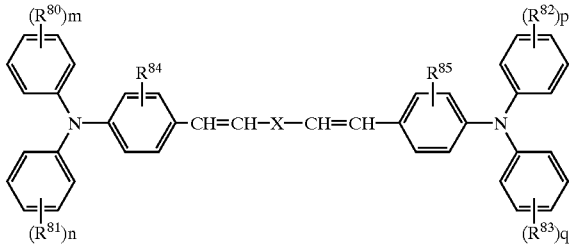

wherein $R^{80}$, $R^{81}$, $R^{82}$ and $R^{83}$ are the same or different and each represents an alkyl group, an alkoxy group, an aryl group, an aralkyl group, or a halogen atom; m, n, p and q are the same or different and each represents an integer of 0 to 3; $R^{84}$ and $R^{85}$ are the same or different and each represents a hydrogen atom or an alkyl group; and —X— represents the formula:

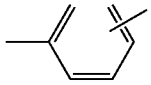

or the formula:

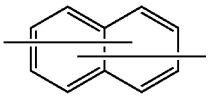

A compound represented by the general formula [9]:

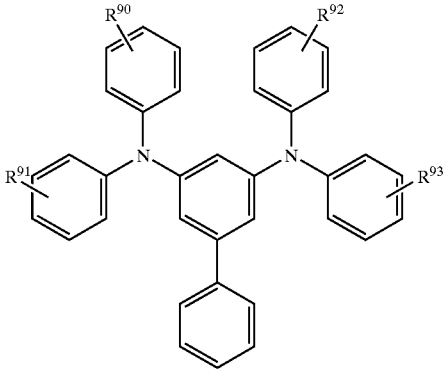

wherein $R^{90}$ and $R^{92}$ are the same or different and each represents an alkyl group which may have a substituent; and $R^{91}$ and $R^{93}$ are different and each represents a hydrogen atom or an alkyl group which may have a substituent.

A compound represented by the general formula [10]:

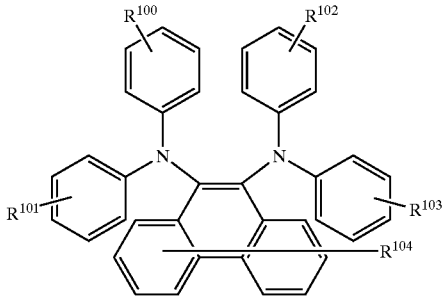

wherein $R^{100}$, $R^{101}$, $R^{102}$, $R^{103}$ and $R^{104}$ are the same or different and each represents a hydrogen atom, a halogen atom, or an alkyl or alkoxy group which may have a substituent.

A compound represented by the general formula [11]:

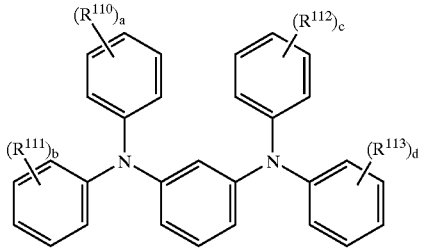

wherein $R^{110}$, $R^{111}$, $R^{112}$ and $R^{113}$ are the same or different and each represents a halogen atom, or an alkyl, alkoxy or aryl group which may have a substituent; and a, b, c and d are the same or different and each represents an integer of 0 to 5, provided that $R^{110}$, $R^{111}$, $R^{112}$ and $R^{113}$ may be different when a, b, c or d is 2 or more.

That is, the binder resin used in the single-layer type electrophotosensitive material of the present invention is characterized in that it contains a polycarbonate resin having a repeating structural unit represented by the general formula [1]. The repeating structural unit represented by the general formula [1] is extremely effective to improve the wear resistance of the photosensitive layer because of high molecular stiffness.

The solid content of the electric charge transferring material in the single-layer type electrophotosensitive material of the present invention is not less than 30% by weight and not more than 50% by weight based on the entire solid content. The electric charge transferring material functions like a plasticizer in the binder resin and an increase of the content reduces the strength of the photosensitive layer and deteriorates the wear resistance. Therefore, the wear resistance is improved by adjusting the solid content of the electric charge transferring material to 50% by weight or less based on the entire solid content. When the solid content of the electric charge transferring material is less than 30% by weight, the photosensitivity is lowered and the resulting single-layer type electrophotosensitive material does not have a practical sensitivity.

In case the binder resin used in the single-layer type electrophotosensitive material of the present invention contains a polycarbonate resin having a repeating structural unit represented by the general formula [1] and a repeating structural unit represented by the general formula [2], the resulting single-layer type electrophotosensitive material exhibits good wear resistance with resect to the photosensitive layer, and is also superior in durability and causes none of blade squeaking, dash mark and toner filming. Since the polycarbonate having a repeating structural unit represented by the general formula [2] has a siloxane bond in a principal chain, it reduces a friction coefficient of a cleaning blade to the surface of the photosensitive layer, and is also effective to improve the wear resistance of the photosensitive layer and prevents blade squeaking. Since the surface energy of the photosensitive layer is lowered, adhesion of the toner to the photosensitive layer, which can cause dash mark or toner filming, is less likely to occur.

When using a polycarbonate resin having repeating structural units represented by the general formulas [1] and [2], since adhesion of the toner to the surface of the photosensitive layer is less likely to occur, as described above, dash mark and toner filming are less likely to occur. It is not necessary to excessively enhance the blade linear pressure; therefore, drum squeaking and scraping of the photosensitive layer can be reduced by conditions of the image formation system.

In case the binder resin used in the single-layer type electrophotosensitive material of the present invention contains a repeating structural unit represented by the general formula [1], a repeating structural unit represented by the general formula [2] and a copolymer polycarbonate resin having a repeating structural unit represented by the general formula [3], as described above, the polycarbonate resin is effective to improve the wear resistance or surface lubricity of the photosensitive layer and the resulting photosensitive material exhibits very high sensitivity. The reason is considered as follows. That is, the polycarbonate resin having a repeating structural unit represented by the general formula [1] and the polycarbonate resin having a repeating structural unit represented by the general formula [2] are effective to improve the wear resistance or surface lubricity of the photosensitive layer, but the both are inferior in compatibility with the electric charge transferring material. To the contrary, the polycarbonate resin having a repeating structural unit represented by the general formula [3] makes it possible to improve the sensitivity because of excellent compatibility with the electric charge transferring material.

As described above, the compatibility of the binder resin with the electric charge transferring material exerts a large influence on electric characteristics. The reason is considered as follows. That is, although the electric charge transferring material is dissolved uniformly in the binder resin thus causing molecular dispersion, poor compatibility with the binder resin causes molecular agglomeration, thereby to lower the efficiency of giving and receiving of electric charges, resulting in less sensitivity. Therefore, a high sensitivity photosensitive material can be obtained by using a binder resin having good compatibility with an electric charge transferring material in combination.

Also in case the single-layer type electrophotosensitive material of the present invention contains at least one of electron transferring materials represented by the general formulas [4] to [7] and at least one of hole transferring materials represented by the general formulas [8] to [11], the resulting photosensitive material exhibits very high sensitivity.

Particularly, since the single-layer type electrophotosensitive material of the present invention contains both hole and electron transferring materials as the electric charge transferring material, a ratio of the total amount of the electric charge transferring material to the amount of the binder resin increases. Furthermore, since the electric charge generating material and the electric charge transferring material are dispersed in the form of particles in the same photosensitive layer, the single-layer type photosensitive material contains a large amount of material dispersed or dissolved in the binder resin as compared with the multilayer type photosensitive material and the compatibility of the electric charge transferring material with the binder resin to be exerted on the sensitivity of the photosensitive material is particularly enhanced.

The electron transferring materials represented by the general formulas [4] to [7] or the hole transferring materials represented by the general formulas [8] to [11] have excellent compatibility with the binder resin (polycarbonate resin having a repeating structural unit represented by the general formula [1] or a repeating structural unit represented by the general formula [2]) used in the single-layer type electrophotosensitive material of the present invention and also exhibit large mobility and, therefore, they are extremely effective to improve the sensitivity of the photosensitive material.

Each alkyl group in the general formulas [4], [6] to [11] includes the alkyl group having 1 to 30 carbon atoms, preferably 1 to 12 carbon atoms, such as methyl group, ethyl group, n-propyl group, iso-propyl group, n-butyl group, t-butyl group, amyl group, or 2-ethylhexyl group.

Each alkoxy group in the general formulas [8], [10] and [11] includes the alkoxyl group having 1 to 30 carbon atoms, preferably 1 to 12 carbon atoms, such as methoxy group, ethoxy group, n-propoxy group, iso-propoxy group, n-butoxy group, iso-butoxy group, or t-butoxy group.

Each aryl group in the general formulas [6], [8], [11] to [14] includes the aryl group having 1 to 30 carbon atoms, preferably 1 to 16 carbon atoms, which may be substituted with alkyl group, alkoxy group or aryl group, such as phenyl group, naphthyl group, tolyl group, xylyl group, ethyl phenyl group, or biphenyl group.

Each aralkyl group in the general formulas [8] and [14] includes the aralkyl group having 7 to 30 carbon atoms, preferably 7 to 12 carbon atoms, which may be substituted with alkyl group or alkoxy group, such as benzyl group, phenethyl group or cumyl group.

The mono valent hydrocarbon group in the general formula [5] includes the alkyl group, aryl group and aralkyl group as exemplified in the general formulas [4], [6] to [11].

Each cycloalkyl group in the general formulas [12] to [14] includes the cycloalkyl group having 3 to 10 carbon atoms, preferably 3 to 8 carbon atoms, such as cyclohexyl group or cyclopentyl group.

DETAILED DESCRIPTION OF THE INVENTION

Figure 1:
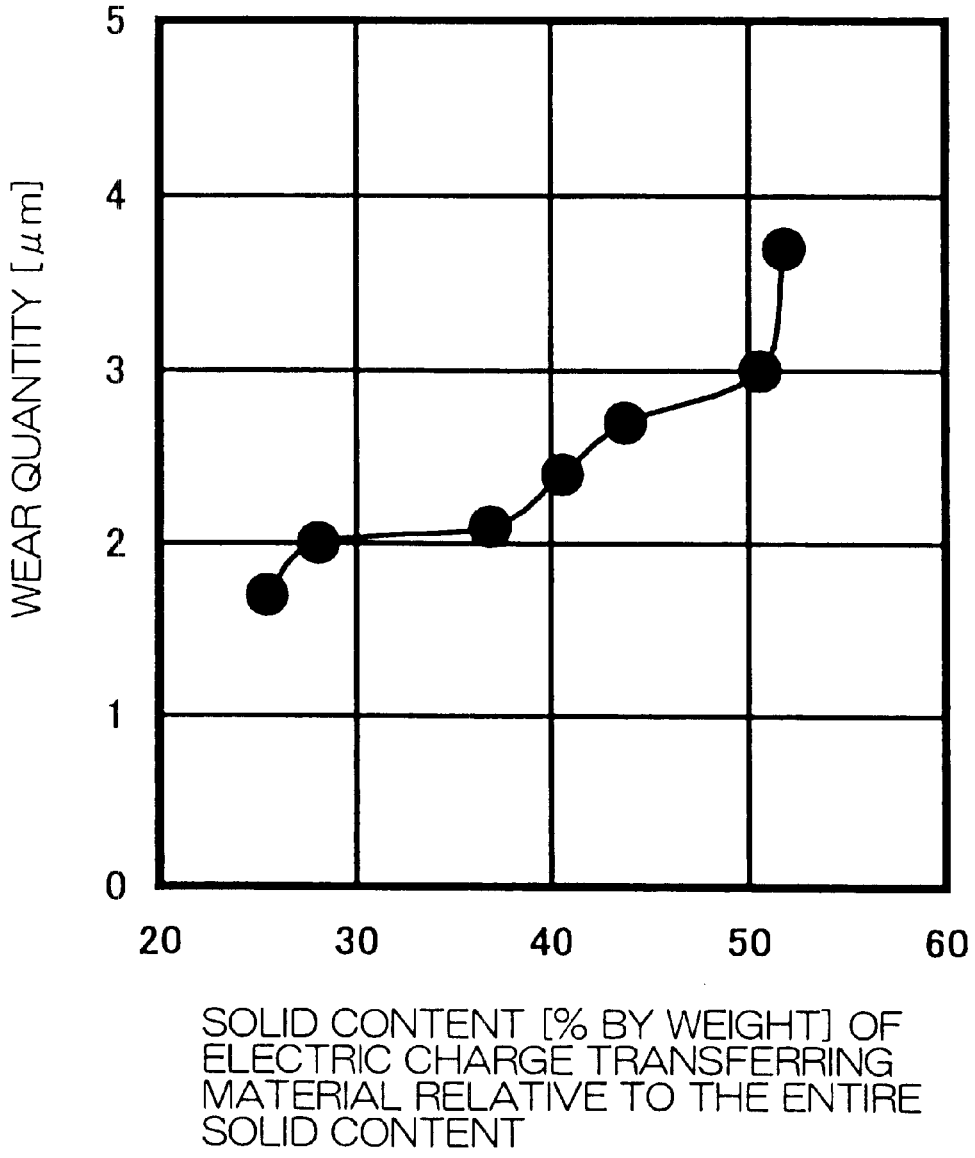
FIG. 1 is a graph showing the relationship between the solid content of an electric charge transferring material (hole transferring material and electron transferring material) relative to the entire solid content and the wear quantity of the photosensitive layer.

Constituent materials of the single-layer type electrophotosensitive material of the present invention will be described in detail below.

Binder Resin

A binder resin used in the single-layer type electrophotosensitive material of the present invention is characterized in that it contains a polycarbonate resin having a repeating structural unit represented by the general formula [1].

The binder resin used in the single-layer type electrophotosensitive material of the present invention may contain at least a polycarbonate resin having a repeating structural unit represented by the general formula [1], and there can be used various resins which have conventionally used in the photosensitive layer.

For example, there can be used thermoplastic resins such as polycarbonate resin (e.g. bisphenol Z, bisphenol ZC, bisphenol C, and bisphenol A type polycarbonate resins), polyester resin, polyarylate resin, styrene-butadiene copolymer, styrene-acrylonitrile copolymer, styrene-maleic acid copolymer, acrylic copolymer, styrene-acrylic acid copolymer, polyethylene, ethylene-vinyl acetate copolymer, chlorinated polyethylene, polyvinyl chloride, polypropylene, ionomer, vinyl chloride-vinyl acetate copolymer, alkyd resin, polyamide, polyurethane, polysulfone, diallyl phthalate resin, ketone resin, polyvinyl butyral resin, and polyether resin; crosslinkable thermosetting resins such as silicone resin, epoxy resin, phenol resin, urea resin, and melamine resin; and photocurable resins such as epoxy acrylate and urethane acrylate. These binder resins can be used alone, or two or more kinds of them can be copolymerized or blended.

As described above, copolymer polycarbonate resins having a repeating unit represented by the general formula [1], a repeating unit represented by the general formula [2] and a repeating unit represented by the general formula [3] are preferably used in combination in order to prevent dash mark, toner filming or drum squeaking, or to improve the sensitivity of the photosensitive material.

The amount of the repeating structural unit represented by the general formula [1] is preferably within a range from 10 to 50% by mole, and particularly preferably from 10 to 20% by mole, based on the total amount of the binder resin. The amount of the repeating structural unit represented by the general formula [2] is preferably within a range from 0.05 to 10% by mole, and particularly preferably from 0.03 to 0.5% by mole, based on the total amount of the binder resin. The amount of the repeating structural unit represented by the general formula [3] is preferably within a range from 50 to 90% by mole based on the total amount of the binder resin.

When the amount of the repeating structural unit represented by the general formula [1] is more than 50% by mole, the wear resistance of the photosensitive layer is improved but the compatibility with the electric charge transferring material is lowered, as described above. When the amount of the repeating structural unit represented by the general formula [2] is more than 10% by mole, the lubricity of the surface of the photosensitive layer is improved but the compatibility with the electric charge transferring material tends to be lowered, similarly. When the amount of the repeating structural unit represented by the general formula [3] is more than 90% by mole, the sensitivity is improved but the wear resistance is lowered.

The binder resin used in the single-layer type electrophotosensitive material of the present invention preferably has a weight-average molecular weight within a range from 10,000 to 400,000, and more preferably from 30,000 to 200,000.

Electric Charge Generating Material

Examples of the electric charge generating material used in the single-layer type electrophotosensitive material of the present invention include conventionally known electric charge generating materials, for example, organic photoconductive materials such as phthalocyanine pigment (e.g. metal-free phthalocyanine, oxotitanyl phthalocyanine, and hydroxygallium phthalocyanine), perylene pigment, bisazo pigment, dithioketopyrrolopyrrole pigment, metal-free naphthalocyanine pigment, metallic naphthalocyanine pigment, squaline pigment, trisazo pigment, indigo pigment, azulenium pigment, cyanine pigment, pyrylium pigment, anthanthrone pigment, triphenylmethane pigment, threne pigment, toluidine pigment, pyrrazoline pigment, and quinacridone pigment; and inorganic photoconductive materials such as selenium, selenium-tellurium, selenium-arsenic, cadmium sulfide, and amorphous silicon.

These electric charge generating materials can be used alone or in combination so that the resulting electrophotosensitive material has an absorption wavelength within a desired range.

In digital optical image forming apparatuses (e.g. laser beam printer, facsimile, etc.) using a light source such as semiconductor laser, a photosensitive material having the sensitivity at a wavelength range of 700 nm or more is required. Therefore, phthalocyanine pigments such as metal-free phthalocyanine, oxotitanyl phthalocyanine and hydroxygallium phthalocyanine are preferably used among the electric charge generating materials described above. The crystal form of the above phthalocyanine pigment is not specifically limited and various phthalocyanine pigments can be used.

The amount of the electric charge generating layer is preferably within a range from 0.1 to 50% by weight, and more preferably from 0.5 to 30% by weight, based on the total weight of the binder resin.

Electric Charge Transferring Material

The single-layer type electrophotosensitive material of the present invention contains a mixture of the electron transferring material and the hole transferring material in the photosensitive layer and the solid content of the hole transferring material and the electron transferring material is not less than 30% by weight and not more than 50% by weight based on the entire solid content.

Electron Transferring Material

As the electron transferring material which can be used in the single-layer type electrophotosensitive material of the present invention, conventionally known arbitrary electron transferring materials can be used. As described above, at least one of compounds represented by the general formulas [4], [5], [6] and [7] is preferably incorporated to improve the photosensitivity.

Examples of conventionally known arbitrary electron transferring material include various compounds having electron acceptability, for example, diphenoquinone derivative, benzoquinone derivative, azoquinone derivative described in Japanese Published Unexamined Patent Application (Kokai Tokkyo Koho) Nos. 2000-147806 and 2000-242009, monoquinone derivative described in Japanese Published Unexamined Patent Application (Kokai Tokkyo Koho) Nos. 2000-075520 and 2000-258936, dinaphthylquinone derivative, dimide tetracarboxylate derivative, imide carboxylate derivative, stilbenequinone derivative, anthraquinone derivative, malononitrile derivative, thiopyran derivative, trinitrothioxanthone derivative, 3,4,5,7-tetranitro-9-fluorenone derivative, dinitroanthracene derivative, dinitroacridine derivative, nitroanthraquinone derivative, dinitroanthraquinone derivative, tetracyanoethylene, 2,4,8-trinitrothioxanthone, dinitrobenzene, dinitroanthracene, dinitroacridine, nitroanthraquinone, dinitroanthraquinone, succinic anhydride, maleic anhydride, and dibromomaleic anhydride.

Examples of the electron transferring material used in the single-layer type electrophotosensitive material of the present invention include compounds represented by the following general formulas [12] to [14], in addition to the compounds represented by the following general formulas [4] to [7].

General formula [12]:

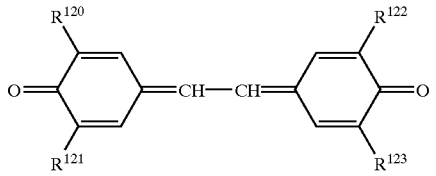

wherein $R^{120}$ to $R^{123}$ are the same or different and each represents a hydrogen atom, an alkyl group having 1 to 12 carbon atoms, an alkoxy group having 1 to 12 carbon atoms, an aryl group which may have a substituent, a cycloalkyl group, an aralkyl group which may have a substituent, or an alkyl halide group, and the substituent represents a halogen atom, an alkoxy group having 1 to 6 carbon atoms, a hydroxyl group, a cyano group, an amino group, a nitro group, or an alkyl halide group.

General formula [13]:

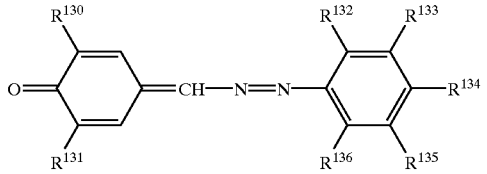

wherein $R^{130}$ and $R^{131}$ are the same or different and each represents a hydrogen atom, an alkyl group having 1 to 12 carbon atoms, an alkoxy group having 1 to 12 carbon atoms, an aryl group which may have a substituent, a cycloalkyl group, an aralkyl group which may have a substituent, or an alkyl halide group; $R^{132}$ to $R^{136}$ are the same or different and each represents a hydrogen atom, a halogen atom, an alkyl group having 1 to 12 carbon atoms, an alkoxy group having 1 to 12 carbon atoms, an aralkyl group which may have a substituent, a phenoxy group which may have a substituent, or an alkyl halide group, and two or more groups thereof may be combined with each other to form a ring, and the substituent represents a halogen atom, an alkyl group having 1 to 6 carbon atoms, an alkoxy group having 1 to 6 carbon atoms, a hydroxyl group, a cyano group, an amino group, a nitro group, or an alkyl halide group.

General formula [14]:

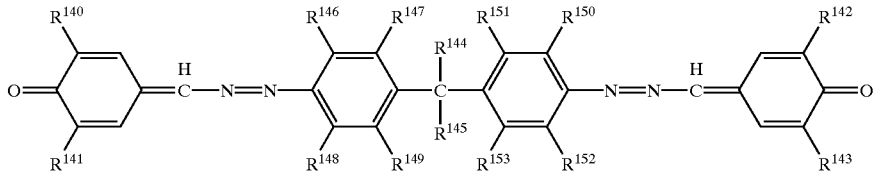

wherein $R^{140}$ to $R^{143}$ are the same or different and each represents a hydrogen atom, an alkyl group having 1 to 12 carbon atoms, an alkoxy group having 1 to 12 carbon atoms, an aryl group which may have a substituent, a cycloalkyl group, an aralkyl group which may have a substituent, or an alkyl halide group; $R^{144}$ and $R^{145}$ are the same or different and each represents a hydrogen atom, or an alkyl group having 1 to 12 carbon atoms; $R^{146}$ to $R^{153}$ are the same or different and each represents a hydrogen atom, a halogen atom, an alkyl group having 1 to 12 carbon atoms, an alkoxy group having 1 to 12 carbon atoms, an aryl group which may have a substituent, or an alkyl halide group, and the substituent represents a halogen atom, an alkyl group having 1 to 6 carbon atoms, an alkoxy group having 1 to 6 carbon atoms, a hydroxyl group, a cyano group, an amino group, a nitro group, or an alkyl halide group.

In the present invention, these electron transferring materials may be used alone or in combination.

Hole Transferring Material

Conventionally known arbitrary hole transferring materials can be used as the hole transferring material used in the single-layer type electrophotosensitive material of the present invention. As described above, one or more compounds represented by the general formulas [8], [9], [10] and [11] are preferably incorporated to improve the photosensitivity.

Examples of the conventionally known arbitrary hole transferring material include nitrogen-containing compounds and condensed polycyclic compounds, for example, N,N,N',N'-tetraphenylbenzidine derivative, N,N,N',N'-tetraphenylphenylenediamine derivative, N,N,N',N'-tetraphenylnaphtylenediamine derivative, N,N,N',N'-tetraphenylphenantolylenediamine derivative, oxadiazole compound [e.g. 2,5-di(4-methylaminophenyl)-1,3,4-oxadiazole], styryl compound [e.g. 9-(4-diethylaminostyryl) anthracene], carbazole compound [e.g. polyvinylcarbazole], organopolysilane compound, pyrazoline compound [e.g. 1-phenyl-3-(p-dimethylaminophenyl)pyrazoline], hydrazone compound, indole compound, oxazole compound, isoxazole compound, thiazole compound, thiadiazole compound, imidazole compound, pyrazole compound, and triazole compound.

In the present invention, these hole transferring materials may be used alone, or two or more kinds of them may be used in combination.

The photosensitive layer of the single-layer type electrophotosensitive material preferably has a film thickness within a range from about 5 to 100 $\mu$m, and more preferably from about 10 to 50 $\mu$m.

In addition to the respective components described above, conventionally known various additives such as oxidation inhibitors, radical scavengers, singlet quenchers, antioxidants (e.g. ultraviolet absorbers), softeners, plasticizers, surface modifiers, excipients, thickeners, dispersion stabilizers, waxes, acceptors and donors can be incorporated into the photosensitive layer as far as electrophotographic characteristics are not adversely affected. To improve the sensitivity of the photosensitive layer, for example, known sensitizers such as terphenyl, halonaphthoquinones and acenaphthylene may be used in combination with the electric charge generating material.

A barrier layer may be formed between the substrate and the photosensitive layer as far as characteristics of the photosensitive material are not prevented.

As the substrate on which the photosensitive layer is formed, for example, various materials having the conductivity can be used. Examples thereof include metals such as iron, aluminum, copper, tin, platinum, silver, vanadium, molybdenum, chromium, cadmium, titanium, nickel, palladium, indium, stainless steel and brass; substrates made of plastic materials prepared by depositing or laminating the above metals; and substrates made of glasses coated with aluminum iodide, tin oxide and indium oxide.

The substrate may be in the form of a sheet or drum according to the structure of the image forming apparatus to be used. The substrate itself may have the conductivity, or the surface of the substrate may have the conductivity. The substrate may be preferably those having a sufficient mechanical strength.

When the photosensitive layer is formed by the coating method, a dispersion is prepared by dispersing and mixing the above electric charge generating material, electric charge transferring material and binder resin, together with a proper solvent, using a known method such as roll mill, ball mill, attritor, paint shaker, or ultrasonic dispersing equipment, and then the resulting dispersion is coated by using a known means and dried. As the solvent to prepare the above dispersion, various organic solvents can be used. Examples thereof include alcohols such as methanol, ethanol, isopropanol, and butanol; aliphatic hydrocarbons such as n-hexane, octane, and cyclohexane; aromatic hydrocarbons such as benzene, toluene, and xylene; halogenated hydrocarbons such as dichloromethane, dichloroethane, chloroform, carbon tetrachloride, and chlorobenzene; ethers such as dimethyl ether, diethyl ether, tetrahydrofuran, ethylene glycol dimethyl ether, and diethylene glycol dimethyl ether; ketones such as acetone, methyl ethyl ketone, and cyclohexanone; esters such as ethyl acetate and methyl acetate; and dimethylformaldehyde, dimethylformamide, and dimethyl sulfoxide. These solvents may be used alone, or two or more kinds of them may be used in combination.

To improve the dispersibility of the electric charge generating material and electric charge transferring material as well as the smoothness of the surface of the photosensitive layer, surfactants and leveling agents may be added.

EXAMPLES

The following Examples and Comparative Examples further illustrate the present invention in detail. The following Examples are embodiment aspects of the present invention and the technical scope of the present invention is not limited to or by the embodiment aspects.

Examples 1 to 10 and Comparative Examples 1 to 4

2.5 Parts by weight of a X type metal-free phthalocyanine ($PcH_2$) as the electric charge generating material, 5 to 80 parts by weight of each of compounds represented by the general formula [8] as the hole transferring material, 30 parts by weight of a compound selected from compounds represented by the general formulas [4], [5], [6] and [7] (corresponding to ETM-1 and ETM-2, ETM-3 and ETM-4, ETM-6, and ETM-7 and ETM-8, respectively) as the electron transferring material, 100 parts by weight of a copolymer polycarbonate resin (Resin-1, weight-average molecular weight:120,000, molar copolymerization ratio a:b= 20.0% by mole: 80.0% by mole) consisting of a repeating unit represented by the general formula [1] and a bisphenol Z type polycarbonate as the binder, as shown in Table 1, and 700 parts by weight of tetrahydrofuran were dispersed or dissolved in a ball mill for 24 hours to prepare a coating solution for single-layer type photosensitive layer. Then, an alumina tube as the substrate was coated with each coating solution by a dip coating method, followed by hot-air drying at 120° C. for 40 minutes to produce single-layer type electrophotosensitive materials having a single photosensitive layer of 29.0 $\mu$m in film thickness, respectively.

Examples 11 to 13

In the same manner as in Example 7, except that HTM-2, HTM-3 and HTM-4, which are compounds represented by the general formulas [9], [10] and [11], were used as the hole transferring material as shown in Table 2, single-layer type electrophotosensitive materials were produced.

Comparative Example 5

In the same manner as in Example 3, except that a bisphenol Z type polycarbonate resin (Resin-3) having a weight-average molecular weight of 120,000 was used alone as binder resin, a single-layer type electrophotosensitive material was produced (see Table 1).

Examples 14 to 17

In the same manner as in Examples 3, 5, 7 and 9, except that 100 parts by weight of a copolymer polycarbonate resin (Resin-2, weight-average molecular weight:120,000, molar copolymerization ratio a:b:c=20.0% by mole: 0.1% by mole: 79.9% by mole) consisting of a repeating unit represented by the general formula [1], a repeating unit represented by the general formula [2] and a bisphenol Z type polycarbonate having a repeating unit represented by the general formula [3] as a binder resin, single-layer type electrophotosensitive materials of Examples 14, 15, 16 and 17 were produced (see Table 3).

[HTM-1]
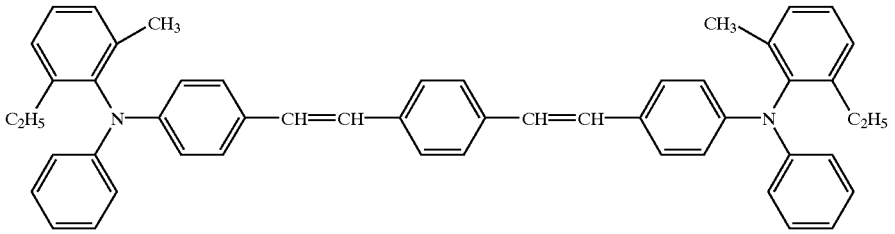
[HTM-2]
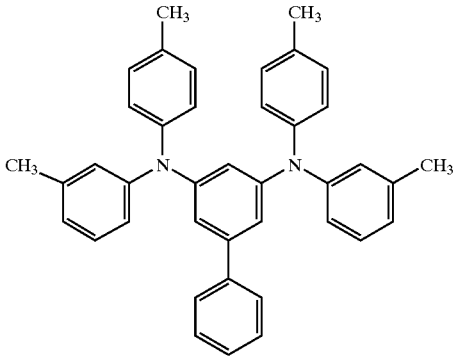
[HTM-3]
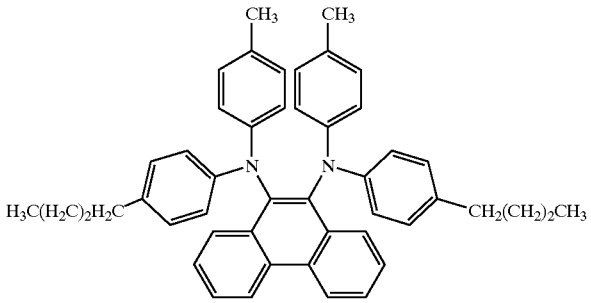
[HTM-4]
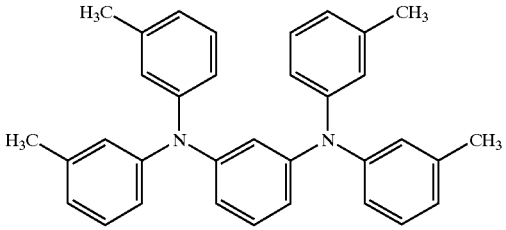
[ETM-1]
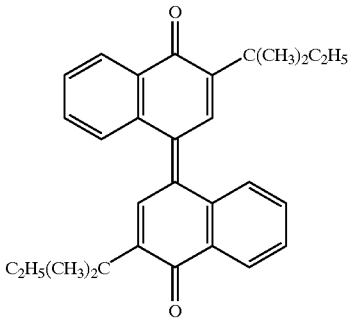
[ETM-2]
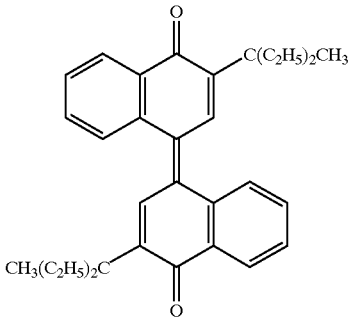
[ETM-3]
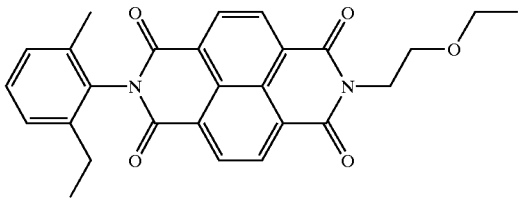
[ETM-4]
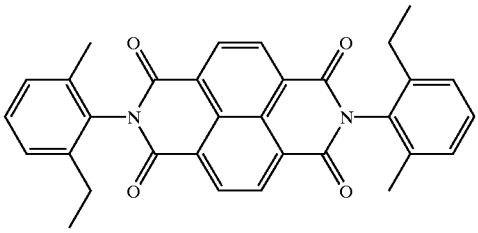
[ETM-5]
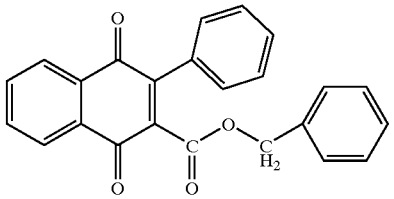

-continued

[ETM-6]

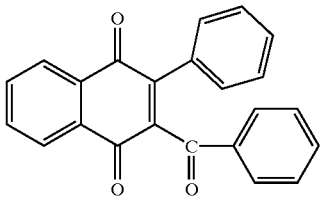

[ETM-7]

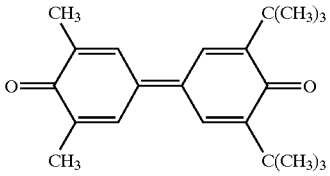

[ETM-8]

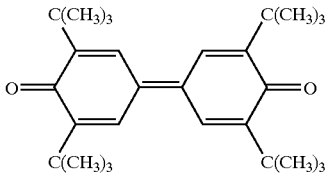

[Resin-1]

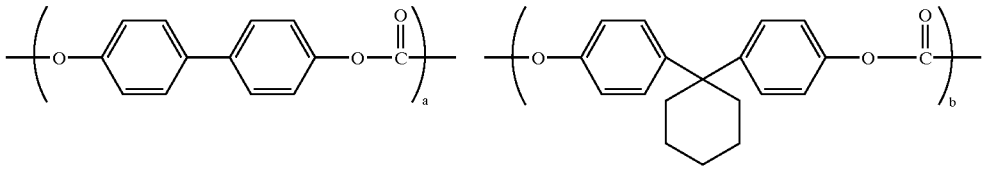

a:b = 20.0:80.0

[Resin-2]

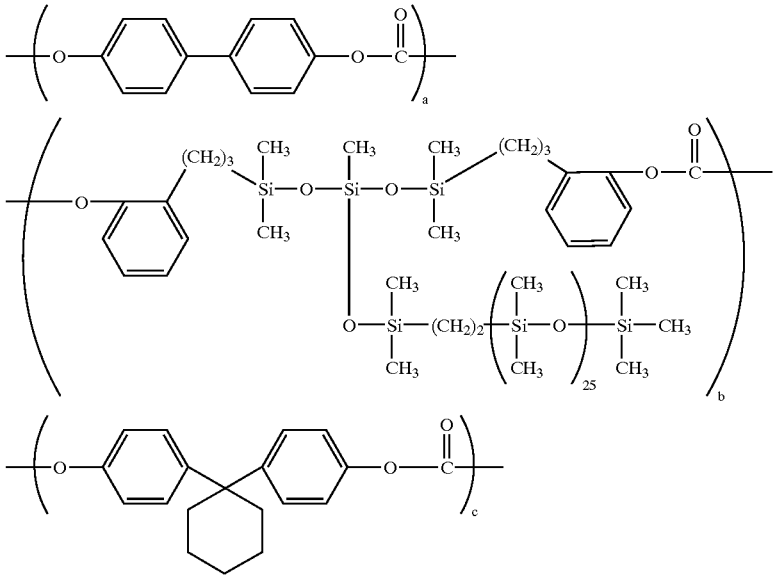

a:b:c = 20.0:0.1:79.9

[Resin-3]

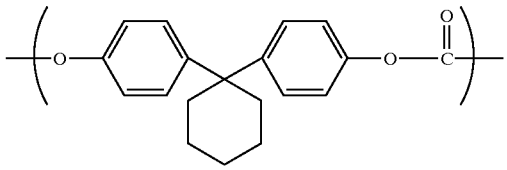

With respect to the photosensitive materials of the respective Examples and Comparative Examples described above, the wear resistance, sensitivity and drum squeaking were evaluated by the following tests.

[Acceleration test for evaluation of wear resistance] The single-layer type photosensitive materials of the respective Examples and Comparative Examples were mounted to a FAX machine ("Creage 8331", manufactured by KYOCERA MITA CORPORATION) equipped with a blade cleaning means and the FAX machine was continuously rotated for 72 hours while exerting a pressing force (blade linear pressure: 2.2 g/mm) on the surface of a drum of the photosensitive material by the cleaning blade without forming an image (neither toner development nor paper passing is not performed). Before and after the test, the film thickness of the photosensitive layer was measured and a change in film thickness was calculated. The smaller the change in film thickness, the better the wear resistance. Samples where the change in film thickness is not more than 3.0 μm were rated "passable", whereas, samples where the change in film thickness is larger than 3.0 μm were rated "failure".

[Test for evaluation of sensitivity] Using a drum sensitivity tester manufactured by GENTEC Co., a voltage was applied on the surface of each of single-layer type photosensitive materials of the respective Examples and Comparative Examples to charge the surface at +700 V, before a printing test. Monochromic light having a wavelength of 780 nm (half-width: 20 nm, 1.0 $\mu J/cm^2$) from white light of a halogen lamp as an exposure light source through a band-pass filter was irradiated on the surface of each photosensitive material, and then a surface potential at the time at which 0.5 seconds have passed since the beginning of exposure was measured as a residual potential (VL). The smaller the value of VL, the better the sensitivity of the photosensitive material. Samples where the value of VL is not more than 120 V were rated "passable", whereas, samples where the value of VL is larger than 120 V were rated "failure".

[Acceleration test for evaluation of drum squeaking] In the same manner as in the test for evaluation of wear resistance, except that the blade linear pressure was increased to 8 g/mm, the FAX machine was continuously rotated for 10 hours while exerting a pressing force on the surface of a drum of the photosensitive material by the cleaning blade, and then the continuous rotation time up to the occurrence of drum squeaking. The single-layer type photosensitive material, which is less likely to cause drum squeaking, requires a long time up to the occurrence of drum squeaking.

Figure 2:
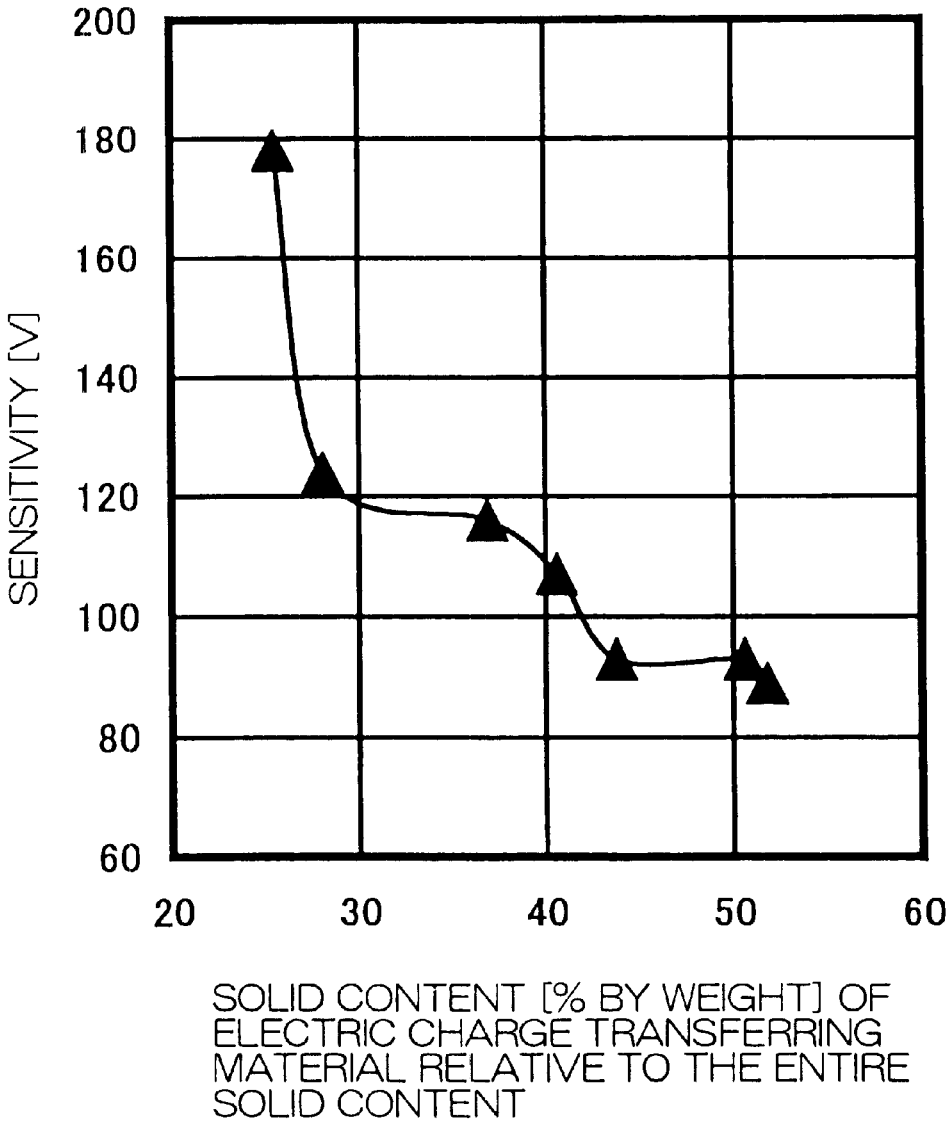
FIG. 2 is a graph showing the relationship between the solid content of an electric charge transferring material (hole transferring material and electron transferring material) relative to the entire solid content and the sensitivity.

The results of the above evaluation tests are shown in Tables 1 to 3 and FIGS. 1 and 2.

TABLE 1

| | Hole transferring material | Content of hole transferring material [parts by weight] | Electron transferring material | Content of electron transferring material [parts by weight] | Solid content of electric charge transferring material [% by weight] |
|---|---|---|---|---|---|
| Example 1 | HTM-1 | 30 | ETM-1 | 30 | 36.9 |
| Example 2 | HTM-1 | 40 | ETM-1 | 30 | 40.6 |
| Example 3 | HTM-1 | 50 | ETM-1 | 30 | 43.8 |
| Example 4 | HTM-1 | 50 | ETM-2 | 30 | 43.8 |
| Example 5 | HTM-1 | 50 | ETM-3 | 30 | 43.8 |
| Example 6 | HTM-1 | 50 | ETM-4 | 30 | 43.8 |
| Example 7 | HTM-1 | 50 | ETM-5 | 30 | 43.8 |
| Example 8 | HTM-1 | 50 | ETM-6 | 30 | 43.8 |
| Example 9 | HTM-1 | 50 | ETM-7 | 30 | 43.8 |
| Example 10 | HTM-1 | 50 | ETM-8 | 30 | 43.8 |
| Comp. Example 1 | HTM-1 | 5 | ETM-1 | 30 | 25.5 |
| Comp. Example 2 | HTM-1 | 10 | ETM-1 | 30 | 28.1 |
| Comp. Example 3 | HTM-1 | 75 | ETM-1 | 30 | 50.6 |
| Comp. Example 4 | HTM-1 | 80 | ETM-1 | 30 | 51.8 |
| Comp. Example 5 | HTM-1 | 50 | ETM-1 | 30 | 43.8 |

| | Binder resin (100 parts by weight) | Wear quantity [μm] | Time up to the occurrence of drum squeaking [hour] | Residual potential (VL) [V] |
|---|---|---|---|---|
| Example 1 | Resin-1 | 2.1 | 6.5 | 116 |
| Example 2 | Resin-1 | 2.4 | 7.0 | 107 |
| Example 3 | Resin-1 | 2.7 | 7.0 | 93 |
| Example 4 | Resin-1 | 2.4 | 6.5 | 97 |
| Example 5 | Resin-1 | 2.5 | 7.0 | 94 |
| Example 6 | Resin-1 | 2.6 | 7.0 | 96 |
| Example 7 | Resin-1 | 2.3 | 6.5 | 98 |
| Example 8 | Resin-1 | 2.5 | 7.0 | 102 |
| Example 9 | Resin-1 | 2.4 | 6.5 | 112 |
| Example 10 | Resin-1 | 2.4 | 6.5 | 114 |
| Comp. Example 1 | Resin-1 | 1.7 | 6.5 | 178 |
| Comp. Example 2 | Resin-1 | 2.0 | 6.5 | 124 |
| Comp. Example 3 | Resin-1 | 3.0 | 6.5 | 93 |
| Comp. Example 4 | Resin-1 | 3.9 | 6.5 | 91 |
| Comp. Example 5 | Resin-3 | 3.7 | 6.5 | 89 |

TABLE 2

| | Hole transferring material | Content of hole transferring material [parts by weight] | Electron transferring material | Content of electron transferring material [parts by weight] | Solid content of electric charge transferring material [% by weight] |
|---|---|---|---|---|---|
| Example 11 | HTM-2 | 50 | ETM-5 | 30 | 43.8 |
| Example 12 | HTM-3 | 50 | ETM-5 | 30 | 43.8 |
| Example 13 | HTM-4 | 50 | ETM-5 | 30 | 43.8 |

| | Binder resin (100 parts by weight) | Wear quantity [μm] | Time up to the occurrence of drum squeaking [hour] | Residual potential (VL) [V] |
|---|---|---|---|---|
| Example 11 | Resin-1 | 2.5 | 7.0 | 105 |
| Example 12 | Resin-1 | 2.4 | 7.0 | 102 |
| Example 13 | Resin-1 | 2.3 | 6.5 | 109 |

TABLE 3

| | Hole transferring material | Content of hole transferring material [parts by weight] | Electron transferring material | Content of electron transferring material [parts by weight] | Solid content of electric charge transferring material [% by weight] |
|---|---|---|---|---|---|
| Example 14 | HTM-1 | 50 | ETM-1 | 30 | 43.8 |
| Example 15 | HTM-1 | 50 | ETM-3 | 30 | 43.8 |
| Example 16 | HTM-1 | 50 | ETM-5 | 30 | 43.8 |
| Example 17 | HTM-1 | 50 | ETM-7 | 30 | 43.8 |

| | Binder resin (100 parts by weight) | Wear quantity [μm] | Time up to the occurrence of drum squeaking [hour] | Residual potential (VL) [V] |
|---|---|---|---|---|
| Example 14 | Resin-2 | 2.2 | 9.5 | 91 |
| Example 15 | Resin-2 | 2.4 | 9.5 | 91 |
| Example 16 | Resin-2 | 2.3 | 10.0 | 94 |
| Example 17 | Resin-2 | 2.0 | 10.0 | 98 |

As is apparent from the results of Tables 1 and 2, the wear quantity of the photosensitive layer of the single-layer type electrophotosensitive materials (Examples 1 to 13) using a polycarbonate resin (Resin-1) having a repeating structural unit represented by the general formula [1] as the binder resin was not more than 3.0 μm. However, the wear quantity of the photosensitive layer of the single-layer type electrophotosensitive material (Comparative Example 5) using a bisphenol Z type polycarbonate (Resin-3) alone as the binder resin was larger than 3.0 μm.

Even in case of the single-layer type electrophotosensitive materials using polycarbonate resin (Resin-1) having a repeating structural unit represented by the general formula [1] as the binder resin, when the solid content of the hole transferring material and the electron transferring material exceeds 50% by weight based on the entire solid content (Comparative Examples 3 and 4), the wear quantity of the photosensitive layer was larger than 3.0 μm. On the other hand, when the solid content is less than 30% by weight (Comparative Examples 1 and 2), the value of $V_L$ was larger than 120 V and sensitivity of the photosensitive material was drastically lowered.

The solid content of the hole transferring material and the electron transferring material in tables was calculated by the following equation: [Solid content (% by weight) of hole transferring material and electron transferring material]=[(content of hole transferring material)+(content of electron transferring material)]/[(content of electric charge generating material)+(content of hole transferring material)+(content of electron transferring material)+(content of binder resin)]×100.

FIG. 1 and FIG. 2 are graphs obtained by plotting the relationship between the solid content of an electric charge transferring material (hole transferring material and electron transferring material) relative to the entire solid content and the wear quantity of the photosensitive layer (FIG. 1) or the sensitivity (FIG. 2) based on the measurement data of Examples 1 to 3 and Comparative Examples 1 to 4. As is apparent from these FIGS. 1 and 2, the solid content of the electric charge transferring material must be within a range from 30 to 50% by weight so that the wear quantity is not more than 3 μm and the residual potential is not more than 120 V. As is apparent from the results of Table 3, when using a copolymer polycarbonate resin (Resin-2) consisting of a repeating unit represented by the general formula [1], a repeating unit represented by the general formula [2] and a bisphenol Z type polycarbonate having a repeating unit represented by the general formula [3] (Examples 14 to 17), the time up to the occurrence of drum squeaking became longer as compared with Examples 3, 5, 7 and 9.

The disclosures of Japanese Patent Application Nos. 2000-258890, 2000-262354 and 2001-043323, filed on Aug. 29, 2000, Aug. 31, 2000 and Feb. 20, 2001, respectively, are incorporated herein by reference.

What is claimed is:

1. A single-layer type electrophotosensitive material comprising a conductive substrate and a photosensitive layer made of a binder resin containing at least an electric charge generating material and a hole transferring material and an electron transferring material as an electric charge transferring material, which is formed on the conductive substrate, wherein the binder resin contains a polycarbonate resin having a repeating structural unit represented by the general formula [1]:

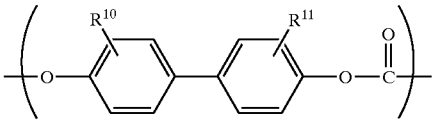

wherein $R^{10}$ and $R^{11}$ are the same or different and each represents a hydrogen atom or an alkyl group having 1 to 3 carbon atoms, and the solid content of the hole transferring material and the electron transferring material is not less than 30% by weight and not more than 50% by weight based on the entire solid content.

2. The single-layer type electrophotosensitive material according to claim 1, wherein the binder resin contains a copolymer polycarbonate resin consisting of a repeating structural unit represented by the general formula [1] and a repeating structural unit represented by the general formula [2]:

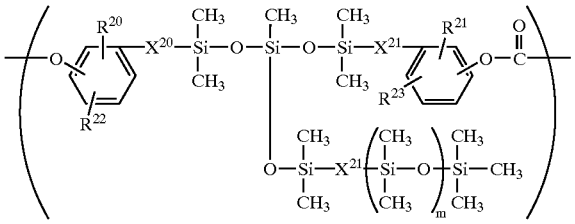

wherein $X^{20}$, $X^{21}$ and $X^{22}$ are the same or different and each represents $—(CH_2)_n—$; n represents an integer of 1 to 6; $R^{20}$, $R^{21}$, $R^{22}$ and $R^{23}$ are the same or different and each represents a hydrogen atom, a phenyl group, or an alkyl or alkoxy group having 1 to 3 carbon atoms; and m represents a numerical value of 0 to 200, or a mixed resin of the polycarbonate resin having a repeating structural unit represented by the general formula [1] and the polycarbonate resin having a repeating structural unit represented by the general formula [2].

3. The single-layer type electrophotosensitive material according to claim 1, wherein the binder resin contains a copolymer polycarbonate resin having a repeating structural unit represented by the general formula [1] and a repeating structural unit represented by the general formula [3]:

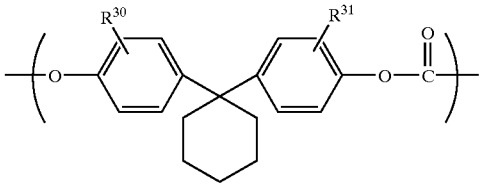

wherein $R^{30}$ and $R^{31}$ are the same or different and each represents a hydrogen atom or an alkyl group having 1 to 3 carbon atoms.

4. The single-layer type electrophotosensitive material according to claim 1, wherein the binder resin contains a copolymer polycarbonate resin having a repeating structural unit represented by the general formula [1], a repeating structural unit represented by the general formula [2] and a repeating structural unit represented by the general formula [3].

5. The single-layer type electrophotosensitive material according to claim 1, which contains the repeating structural unit represented by the general formula [1] in an amount of 10 to 50% by mole based on the total amount of the binder resin.

6. The single-layer type electrophotosensitive material according to claim 2, which contains the repeating structural unit represented by the general formula [2] in an amount of 0.05 to 10% by mole based on the total amount of the binder resin.

7. The single-layer type electrophotosensitive material according to claim 3, which contains the repeating structural unit represented by the general formula [3] in an amount of 50 to 90% by mole based on the total amount of the binder resin.

8. The single-layer type electrophotosensitive material according to claim 4, which contains the repeating structural unit represented by the general formula [3] in an amount of 50 to 90% by mole based on the total amount of the binder resin.

9. The single-layer type electrophotosensitive material according to claim 1, wherein the electric charge generating material is a phthalocyanine pigment.

10. The single-layer type electrophotosensitive material according to claim 1, wherein the electron transferring material contains one or more compounds selected from the group consisting of a compound represented by the general formula [4]:

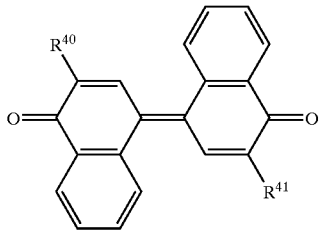

wherein $R^{40}$ and $R^{41}$ are the same or different and each represents an alkyl group which may have a substituent, a compound represented by the general formula [5]:

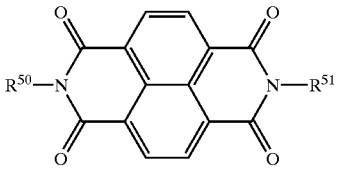

wherein $R^{50}$ and $R^{51}$ are the same or different and each represents a monovalent hydrocarbon group which may have a substituent, a compound represented by the general formula [6]:

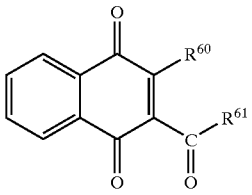

wherein $R^{60}$ represents a halogen atom, or an alkyl or aryl group which may have a substituent; $R^{61}$ represents an alkyl or aryl group which may have a substituent, or a group: —O—$R^{61a}$; and $R^{61a}$ represents an alkyl or aryl group which may have a substituent, and a compound represented by the general formula [7]:

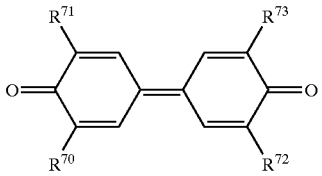

wherein $R^{70}$, $R^{71}$, $R^{72}$ and $R^{73}$ are same or different and each represents an alkyl group which may have a substituent.

11. The single-layer type electrophotosensitive material according to claim 1, wherein the hole transferring material contains one or more compounds selected from the group consisting of a compound represented by the general formula [8]:

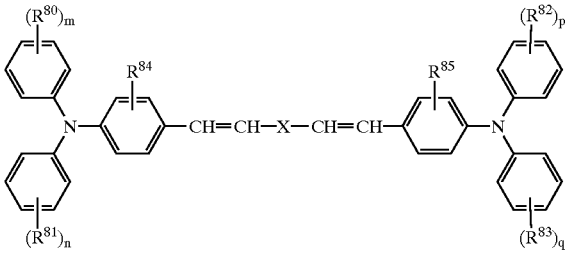

wherein $R^{80}$, $R^{81}$, $R^{82}$ and $R^{83}$ are the same or different and each represents an alkyl group, an alkoxy group, an aryl group, an aralkyl group, or a halogen atom; m, n, p and q are the same or different and each represents an integer of 0 to 3; $R^{84}$ and $R^{85}$ are the same or different and each represents a hydrogen atom or an alkyl group, and —X— represents the formula:

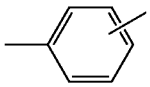

or the formula:

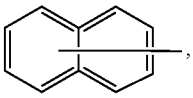

a compound represented by the general formula [9]:

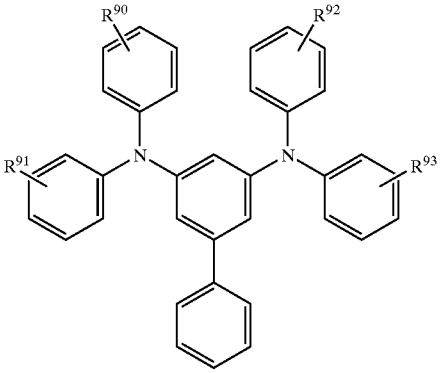

wherein $R^{90}$ and $R^{92}$ are same or different and each represents an alkyl group which may have a substituent; and $R^{91}$ and $R^{93}$ are the same or different and each represents a hydrogen atom or an alkyl group which may have a substituent, a compound represented by the general formula [10]:

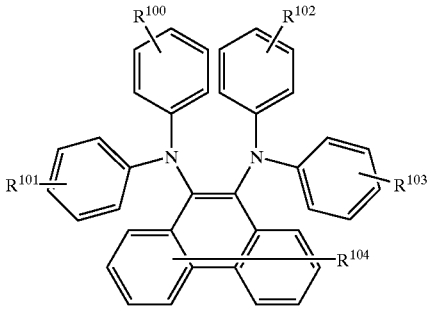

wherein $R^{100}$, $R^{101}$, $R^{102}$, $R^{103}$ and $R^{104}$ are the same or different and each represents a hydrogen atom, a halogen atom, or an alkyl or alkoxy group which may have a substituent, and a compound represented by the general formula [11]:

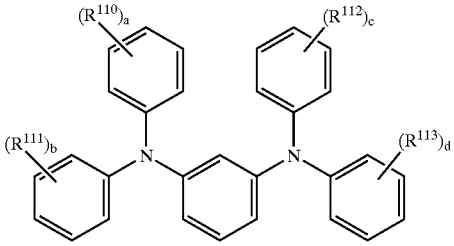

wherein $R^{110}$, $R^{111}$, $R^{112}$ and $R^{113}$ are the same or different and each represents a halogen atom, or an alkyl, alkoxy or aryl group which may have a substituent; and a, b, c and d are the same or different and each represents an integer of 0 to 5, provided that $R^{110}$, $R^{111}$, $R^{112}$ and $R^{113}$ may be different when a, b, c or d is 2 or more.

12. The single-layer type electrophotosensitive material according to claim 1, which is used in an image forming apparatus for recovering a non-transferred toner by a blade cleaning means.

13. The single-layer type electrophotosensitive material according to claim 2, which is used in an image forming apparatus for recovering a non-transferred toner by a blade cleaning means.

14. The single-layer type electrophotosensitive material according to claim 3, which is used in an image forming apparatus for recovering a non-transferred toner by a blade cleaning means.

15. The single-layer type electrophotosensitive material according to claim 4, which is used in an image forming apparatus for recovering a non-transferred toner by a blade cleaning means.

* * * * *

UNITED STATES PATENT AND TRADEMARK OFFICE

CERTIFICATE OF CORRECTION

PATENT NO. : 6,593,047 B2
DATED : July 15, 2003
INVENTOR(S) : Azuma, Jun et al.

It is certified that error appears in the above-identified patent and that said Letters Patent is hereby corrected as shown below:

Title page,
Item [75], Inventors, should read
-- [75] Inventors: Jun Azuma, Osaka (JP); Yukimasa Watanabe, Osaka (JP); Hisalazu Honma, Osaka (JP); Ayako Yashima, Osaka (JP); Maki Uchida, Osaka (JP); Kyoicki Nakamura, Osaka (JP); Eiichi Miyamoto, Osaka (JP) --

Signed and Sealed this

Twenty-eighth Day of June, 2005

JON W. DUDAS
*Director of the United States Patent and Trademark Office*

UNITED STATES PATENT AND TRADEMARK OFFICE

CERTIFICATE OF CORRECTION

PATENT NO. : 6,593,047 B2
APPLICATION NO. : 09/942654
DATED : July 15, 2003
INVENTOR(S) : Jun Azuma et al.

It is certified that error appears in the above-identified patent and that said Letters Patent is hereby corrected as shown below:

On the first page of the patent, the Inventors section should read as follows:

(75) Inventors: Jun Azuma, Osaka (JP); Yukimasa Watanabe, Osaka (JP); Hisakazu Honma, Osaka (JP): Ayako Yashima, Osaka (JP); Maki Uchida, Osaka (JP); Kyoichi Nakamura, Osaka (JP); Elichi Miyamoto, Osaka (JP)

Signed and Sealed this

Fourteenth Day of November, 2006

JON W. DUDAS
*Director of the United States Patent and Trademark Office*